United States Patent [19]

Sung et al.

[11] Patent Number: 4,643,738

[45] Date of Patent: Feb. 17, 1987

[54] POLYOXYISOPROPYLENEDIAMINE-ACID ANHYDRIDE-N-ALKYL-ALKYLENE DIAMINE REACTION PRODUCT AND MOTOR FUEL COMPOSITION CONTAINING SAME

[75] Inventors: Rodney L. Sung, Fishkill; Robert H. Jenkins, Jr., Walden, both of N.Y.

[73] Assignee: Texaco Inc., White Plains, N.Y.

[21] Appl. No.: 780,141

[22] Filed: Sep. 27, 1985

[51] Int. Cl.[4] ..... C10L 1/22

[52] U.S. Cl. ..... 44/63; 44/71

[58] Field of Search ..... 44/63, 71

[56] References Cited

U.S. PATENT DOCUMENTS

| | | | |
|---|---|---|---|
| 3,455,832 | 7/1969 | Davis | 44/63 |
| 3,920,698 | 11/1975 | Haemmerle et al. | 44/63 |
| 3,980,448 | 9/1976 | Haemmerle | 44/63 |
| 4,419,105 | 12/1983 | Sung | 44/71 |
| 4,477,261 | 10/1984 | Sung | 44/71 |
| 4,536,189 | 8/1985 | Sung | 44/63 |

*Primary Examiner*—Y. Harris-Smith

*Attorney, Agent, or Firm*—Robert A. Kulason; James J. O'Loughlin; Vincent A. Mallare

[57] ABSTRACT

Gasoline of reduced combustion chamber deposit attained by addition of, as additive, a reaction product of polyoxyisopropylenediamine-maleic anhydride-N-tallow-1,3-propane diamine.

9 Claims, No Drawings

POLYOXYISOPROPYLENEDIAMINE-ACID ANHYDRIDE-N-ALKYL-ALKYLENE DIAMINE REACTION PRODUCT AND MOTOR FUEL COMPOSITION CONTAINING SAME

BACKGROUND OF THE INVENTION

Field of the Invention

This invention relates to hydrocarbon fuels containing additives which reduce the deposit tendency of hydrocarbon fuels. More specifically, this invention discloses motor fuels obtained by the addition of a minor amount of a reaction product of polyoxyisopropylenediamine, maleic anhydride and N-alkyl-alkylene diamine.

As automobile manufacturers increase the compression ratio of their automobile engines to obtain higher horsepower, the need becomes greater for gasolines which burn cleanly and have low deposit forming tendencies. Engine deposits which find their origin in the fuel are primarily responsible for surface ignition phenomena such as pre-ignition and octane requirement increase (ORI) which is the tendency of increasing octane requirement during the first several thousand miles of operation. Basically this octane requirement increase is caused by deposits building up in the engine's combustion chambers which can cause engine 'knock' or 'ping'. Formally, knock or ping was stopped by either de-tuning the car's engine or by changing to a higher octane gasoline. The combustion chamber deposits also can cause engine run-on which is the sputter and clatter that is heard sometimes after an engine has been turned off. The present invention seeks to reduce the building up of deposits in an engine's combustion chamber so as to reduce engine knock and run-on and avoid octane requirement increased requiring the switch to a premium grade of gasoline.

In addition, the presence and accumulation of carbon deposits in and around the carburetor restrict the flow of air through the carburetor at idle and at low speeds, resulting in an overrich fuel mixture. This condition produces further incomplete fuel combustion, resulting in rough engine idling and engine stalling, as well as excessive hydrocarbon and carbon monoxide exhaust emissions into the atmosphere. It would thus be desirable in view of both engine operability and overall air quality to provide a fuel composition which minimizes or overcomes the above-described problems.

U.S. Pat. No. 4,321,062 discloses the use of the reaction product of maleic anhydride, certain phenols, and certain alkyl-alkylene diamine as a corrosion inhibitor and carburetor detergent additive in motor fuels.

U.S. Pat. No. 4,290,778 discloses the use of the reaction product of a hydrocarbyl alkoxyalkylene diamine and maleic anhydride as a corrosion inhibitor and carburetor detergent additive in motor fuels.

U.S. Pat. No. 4,207,079 discloses the use of the reaction product of maleic anhydride and certain alkyl-alkylene diamines as a corrosion inhibitor and a carburetor detergent additive in motor fuels.

U.S. Pat. No. 4,144,034 discloses the use of the reaction product of a polyether amine and maleic anhydride as a carburetor detergent and corrosion inhibitor in motor fuels.

U.S. Pat. No. 3,773,479 discloses the use of the reaction product of maleic anhydride and alkyl or alkylene amines as a carburetor detergent, corrosion inhibitor, and anti-icing additive in motor fuels.

SUMMARY OF THE INVENTION

It has now been discovered that the reaction product, of maleic anhydride, a polyoxyisopropylenediamine, and a N-alkyl-alkylene diamine has utility as a combustion chamber deposit inhibitor and carburetor detergent when employed in a motor fuel composition. The novel reaction product of the instant invention is obtained by (i) reacting a dibasic acid anhydride with a polyoxyisopropylenediamine $$NH_2-\underset{\underset{CH_3}{|}}{CH}-CH_2-[O-CH_2-\underset{\underset{CH_3}{|}}{CH}]_x-NH_2$$

where x has a value of from about 2 to about 68, thereby forming a maleamic acid;

(ii) reacting the maleamic acid with an N-alkyl-alkylene diamine $$R'-NH-R''-NH_2$$

where R' is a ($C_8$–$C_{18}$) hydrocarbon group and R'' is a ($C_1$–$C_8$) hydrocarbon group, thereby forming a condensate product; and (iii) recovering the condensate product.

This invention is also directed to a motor fuel composition containing the above described reaction product, i.e., condensate, product which exhibits substantially reduced combustion chamber deposition which in return may reduce ORI.

DETAILED DESCRIPTION OF THE INVENTION

The novel reaction product of this invention is prepared by reacting a dibasic acid anhydride, e.g., maleic anhydride, a polyoxyisopropylenediamine, and N-alkyl-alkylene diamine.

The polyoxyisopropylenediamine reactant is represented by the formula $$NH_2-\underset{\underset{CH_3}{|}}{CH}-CH_2-[O-CH_2-\underset{\underset{CH_3}{|}}{CH}]_x-NH_2$$

where x has a value of from about 2 to about 50, preferably from about 4 to about 10.

The molecular weight $\overline{M}_n$ of the polyoxyisopropylenediamines may range from about 230 to about 4000. Examples of the polyoxyisopropylenediamine which may be employed herein include those listed below in Table I. These polyoxyisopropylene-diamines are commercially available under the tradename of JEFFAMINE-D which are manufactured by Texaco Chemical Company of Houston, Tex.

TABLE I

A. JEFFAMINE D-230

$$NH_2-\underset{\underset{CH_3}{|}}{CH}-CH_2-(OCH_2-\underset{\underset{CH_3}{|}}{CH})_x-NH_2$$

(where x is 2 or 3)

B. JEFFAMINE D-400

TABLE I-continued $$NH_2-\underset{\underset{CH_3}{|}}{CH}-CH_2-(OCH_2-\underset{\underset{CH_3}{|}}{CH})_x-NH_2$$

(where x is 5 or 6)

C. JEFFAMINE D-2000

$$NH_2-\underset{\underset{CH_3}{|}}{CH}-CH_2-(OCH_2-\underset{\underset{CH_3}{|}}{CH})_x-NH_2$$

(where x is 33)

(where x is 33)

The dibasic acid anhydrides of the present invention, may be represented by the formula

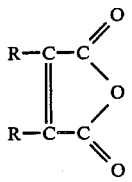

where R is H, $CH_3$— or $C_2H_5$—.

Accordingly, the dibasic acid anhydrides may include the following:

maleic anhydride
alpha-methyl maleic anhydride
alpha-ethyl maleic anhydride
alpha, beta-dimethyl maleic anhydride The preferred dibasic acid anhydride is maleic anhydride.

The N-alkyl-alkylene diamines which may be employed in the present process include polyamines preferably diamines, which bear at least one primary amine-$NH_2$ group and at least one substituted primary amine group. The latter may be di-substituted, but more preferably it is mono-substituted. The hydrocarbon nucleus of the amine may be aliphatic or aromatic including alkyl, alkaryl, aralkyl, aryl, or cyclalkyl in nature. The preferred amine may be of the formula:

$$R'-NH-R''-NH_2$$

wherein R' is a $C_8$–$C_{18}$ hydrocarbon group and R'' is a $C_1$–$C_8$ hydrocarbon group. In the preferred amines, i.e., mono-substituted primary amines, R' may be an alkyl, alkaryl, aralkyl, aryl, or cycloalkyl hydrocarbon group and R'' may be an alkylene, aralkylene, alkarylene, arylene, or cycloalkylene hydrocarbon group.

Ilustrative of the preferred N-alkyl-alkylene diamines include those which are commercially available under the tradename of DUOMEENS and manufactured by Akzo Chemie of America, of Chicago, Ill. These preferred diamines are listed below in Table II.

TABLE II

A. The Duomeen O brand of N—oleyl-1,3,-propane diamine.
B. The Duomeen S brand of N—stearyl-1,3-propane diamine.
C. The Duomeen T brand of N—tallow-1,3-propane diamine.
D. The Duomeen C brand of N—coco-1,3-propane diamine.

The most preferred diamine, R'—NH—R''—$NH_2$, is that where the R'' group is propylene, —$CH_2CH_2CH_2$— and the R' group is a $C_8$–$C_{18}$ n-alkyl group.

It will be apparent to those skilled in the art that several reactants may be inert substituents which are typified by alkyl, alkoxy, halogen, nitro, cyano, haloalkyl, etc. It will also be apparent that the preferred compounds to be employed will be those which are soluble in the solvents compatible with the system in which the product is to be employed.

The reaction product is prepared by first reacting maleic anhydride with the prescribed polyoxyisopropylenediamine. The reaction of 1–2 mole, say 1 mole of maleic anhydride with 1–2 moles, say 1.0 mole of the polyoxyisopropylenediamine is preferably carried out in the presence of a solvent. A preferred solvent is one which will distill with water azeotropically. Suitable solvents include hydrocarbons boiling in the gasoline boiling range of about 30° C. to about 200° C. Generally, this will include saturated and unsaturated hydrocarbons having from about 5 to about 10 carbon atoms. Specific suitable hydrocarbon solvents include hexane, cyclohexane, benzene, toluene, and mixtures thereof. Xylene is the preferred solvent. The solvent can be present in an amount of up to about 90% by weight of the total reaction mixture. Then, the mixture is cooled to about 60° C. where 1 to 2 moles of an N-alkyl-alkylene diamine is added. The mixture with the diamine is continued to be heated for 2 hours at 100° C. After vacuum stripping the solvent from the mixture, the resulting product is the instant condensate product.

In a preferred method for preparing the reaction product, the 1 mole maleic anhydride and 1 mole polyoxyisopropylenediamine are combined with the solvent xylene and reacted at a temperature of about 100° C. The reaction mixture is maintained at this temperature for approximately 2 hours. The mixture is then cooled to about 60° C., whereupon 1–2 mole, say 1 mole of polyalkylene polyamine is added. The new mixture is then reacted at about 100° C. for approximately 2 hours. The reaction product can then be separated from the solvent using conventional means, or left in admixture with some or all of the solvent to facilitate addition of the reaction product to gasoline or another motor fuel composition. The final reaction product structure (as evidenced by elemental analysis, IR analysis, and NMR analysis) may be represented by the following flow process diagram.

In the process illustrated below, initially, maleic anhydride (A) is reacted with polyoxyisopropylenediamine (B) to form maleamic acid (C). Then, the maleamic acid (C) is reacted with an N-alkyl-alkylene diamine (D) to form the condensate product (E) of polyoxyisopropylenediamine, maleic anhydride, and N-alkyl-alkylene diamine. Accordingly, the condensate product (E) is recovered.

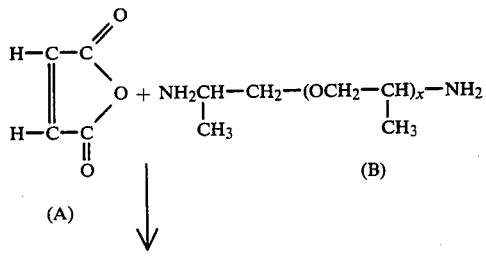

-continued

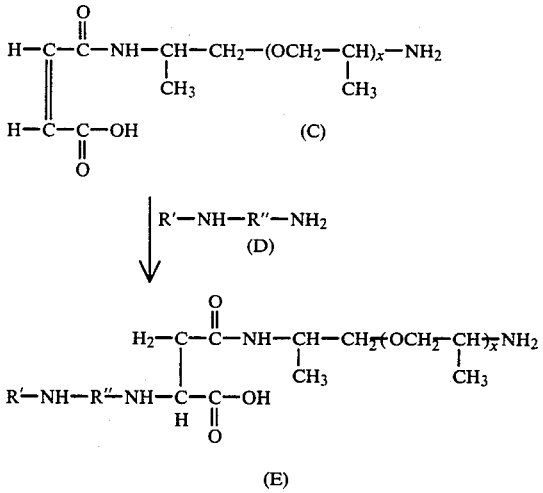

where R′ is a $C_8$–$C_{18}$ alkyl, alkaryl, aralkyl, aryl, or cycloalkyl hydrocarbon group and R″ may be a ($C_1$–$C_3$) alkylene, aralkylene, alkarylene, arylene, or cycloalkylene hydrocarbon group, and x is a numeral of about 2 to about 68.

The prepared reaction product, i.e., condensate product may be added to a fuel in a minor deposit-inhibiting amount of about 0.001 to about 0.1 weight percent, and preferably from about 0.01 to about 0.1 weight percent of the reaction product.

The advantages and features of the present invention will be more apparent from the Examples below. The following examples illustrate the preferred method of preparing the reaction product of the instant invention. It will be understood that the following examples are merely illustrative, and are not meant to limit the invention in any way. In the examples, all parts are parts by weight unless otherwise specified.

EXAMPLE I

A reaction product was formed by reacting 6.1 parts of maleic anhydride. 260 parts of xylene, and 123 parts of the polyoxyisopropylenediamine JEFFAMINE D-2000 at 100° C. for 2 hours. JEFFAMINE D-2000 is a polyoxyisopropylenediamine of approximate molecular weight of 2000 having the general formula:

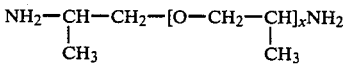

where x is a numeral of about 2 to about 68, preferably of about 2 to about 50, and more preferably from about 33. The mixture was thereafter cooled to about 60° C., and 23.4 parts of Duomeen T was added. The new mixture was then reacted at about 100° C. for 2 hours to produce the final reaction product. The reaction product was filtered and stripped of the remaining solvent under a vacuum. The final reaction product structure (as evidenced by elemental analysis, IR analysis, and NMR analysis) was as previously described and represented below.

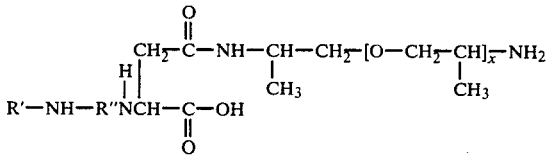

where x has a value of from about 2 to about 50 depending upon the particular polyoxyisopropylene JEFFAMINE D reactant employed, R′ is a ($C_8$–$C_{18}$) alkyl, alkaryl, aralkyl, aryl or cycloalkyl hydrocarbon group and R″ is ($C_1$–$C_8$) alkylene, aralkylene, alkarylene, arylene or cycloalkylene hydrocarbon group.

EXAMPLE II

A reaction procut was formed by reacting 24.5 parts of maleic anhydride, 175 parts of xylene, and 102.7 parts of the polyoxyisopropylene diamine JEFFAMINE D-400 at 100° C. for 2 hours. JEFFAMINE D-400 is a polyether diamine of an approximate molecular weight of 400 having the general formula:

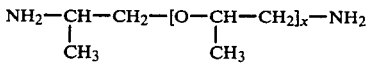

where x has an approximate value of 5–6 polyoxyisopropylene groups. The mixture was thereafter cooled to about 60° C., and 93.5 parts of n-tallow-1,3-diaminopropane (DUOMEEN T) were added. The new mixture was then reacted at about 100° C. for 2 hours to produce the final reaction product. The reaction product was filtered and stripped of the remaining solvent under a vacuum.

EXAMPLE III

A reaction product was formed by reacting 49 parts of the maleic anhydride, 260 parts of xylene, and 574 parts of the polyether diamine JEFFAMINE D-230 at 100° C. for 2 hours. JEFFAMINE D-230 is a polyether diamine of an approximate molecular weight of 230 having the general formula:

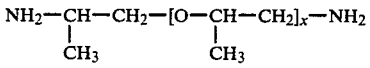

where x has an approximate value of 2–3 polyoxyisopropylene groups. The mixture was thereafter cooled to about 600° C. and 187 parts of n-tallow-1,3-diaminopropane (DUOMEEN T) were added. The new mixture was then reacted at about 100° C. for 2 hours to produce the final reaction product. The reaction product was filtered and stripped of the remaining solvent under a vacuum.

EXAMPLE IV

A reaction product is formed by reacting 9.8 parts of maleic anhydride, 175 parts of xylene, and 400 parts of the polyether diamine JEFFAMINE D-4000 at 100° C. for 2 hours. JEFFAMINE D-4000 is a polyether diamine of approximate molecular weight 4000 having the general formula:

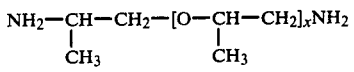

where x has an approximate value of 68.

The mixture was thereafter cooled to about 60° C., and 37.4 parts of n-tallow-1,3-diaminopropane (DUOMEEN T) were added. The new mixture was then reacted at about 100° C. for 2 hours to produce the final reaction product. The reaction product was filtered and stripped of remaining solvent under vacuum.

The hydrocarbon fuels which may be treated by the process of this invention include liquid hydrocarbon fuels boiling in the gasoline boiling range. Commonly these fuels may be provided below in Table III.

TABLE III

| Property | Broad | Preferred | Typical |
|---|---|---|---|
| ibp (°F.) | 80–100 | 85–95 | 92 |
| 50% bp (°F.) | 150–300 | 200–250 | 216 |
| 90% bp (°F.) | 300–450 | 330–400 | 334 |
| API Gravity | 50–65 | 55–60 | 61 |

These fuels may be fully formulated gasoline compositions (containing standard commercial additive packages) having a road octane number (RON) of 80–98, preferably 85–95, say 93 and a motor octane number (MON) of 75–95, preferably 80–90, say 83. The fuels may be summer or winter grades, high or low octane, leaded or unleaded, etc. Unleaded gasolines may particularly benefit from practice of this invention.

Illustrative formulations may include those listed below in Table IV.

TABLE IV

1. A fully formulated unleaded summer grade gasoline (containing a full line of additives) including a hydrocarbon of ibp of 84° F., 50% pb of 218° F., 90% bp of 344° F., and API Gravity of 58.4 containing 100 PTB Example I of the table supra.

2. A fully formulated leaded summer grade gasoline (containing a full line of additives) including a hydrocarbon of ibp of 84° F., 50% bp of 201° F., 90% bp of 343° F. and API Gravity of 61.5 containing 100 PTB of the Example I of the table supra.

3. A fully formulated leaded winter grade gasoline (containing a fully line of additives) including a hydrocarbon of ibp of 80° F., 50% bp of 192° F., 90% bp of 334° F., and API Gravity of 63.8 containing 100 PTB of the Example II of the table supra.

4. A fully formulated unleaded winter grade gasoline (containing a full line of additive) including a hydrocarbon of ibp of 79° F., 50% bp of 205° F., 90% pb of 336° F. and API Gravity of 61.5 containing 100 PTB of the Example IV of the table supra.

It has been found that a motor fuel composition containing the reaction product of the instant invention is effective in minimizing and reducing gasoline internal combustion engine deposit.

This is an improvement in the performance which may reduce the incidence of knock. This invention was tested by the Combustion Chamber Deposit Screening Test (CCDST). In this test, the deposit-forming tendencies of a gasoline are measured; and the amount of deposit correlates with the ORI performance observed in car tests and engine tests. The amount of deposit is compared to a high reference (a standard gasoline known to have a high deposit) and as a low reference (an unleaded base fuel which is known to have a low deposit). Practice of this invention desirably permits attainment of a CCDST rating or equivalent below that of the low reference.

THE COMBUSTION CHAMBER DEPOSIT SCREEN TEST (CCDST)

The Combustion Chamber Deposit Screening Test (CCDST) determines whether the additives is effective as a deposit control additive to prevent octane requirement increase. In this test, the additive sample is dissolved in unleaded gasoline in a concentration of 100 pounds per thousand barrels (PTB). In a nitrogen/air environment the test fuel is then atomized and sprayed onto a heated aluminum tube. After 100 minutes, the deposits which have formed on the tube are weighed. (Gasolines which form larger amounts of deposits on the heated aluminum tube cause the greatest octane requirement increase (ORI) when employed in an internal combustion engine.

Practice of the process of this invention will be apparent to those skilled in the art from the following wherein, as elsewhere in this description, all parts are parts be weight unless otherwise specified. An asterisk indicates a control example.

In this series of runs, the hydrocarbon fuel is an unleaded base fuel (UBF), containing the instant additive having the properties provided below in Table V.

TABLE V

| Property | Value |
|---|---|
| ibp (°F.) | 92 |
| 50% bp (°F.) | 216 |
| 90% bp (°F.) | 334 |
| API Gravity | 61.0 |
| RON | 93.2 |
| MON | 83.3 |

The gasoline contains 30% aromatics, 17% olefins, and 53% saturates.

In Example I, the reaction product of polyoxyisopropylenediamine, maleic anhydride and DUOMEEN T was used at 100 PTB in unleaded gasoline and tested by the Combustion Chamber Deposits Screening Test (CCDST). The amount of deposits formed on the tube after 100 minutes was then determined and reported in milligrams.

Also tested was a standard gasoline (Example A) known to yield a large deposit as the high reference and a standard unleaded gasoline (Example B) known to yield a low deposit as the low reference. The results were as shown below in Table VI.

TABLE VI

| Example | Sample of Example | CCDST (mg) |
|---|---|---|
| I | I | 5.5 |
| A | High Reference | 8.3 |
| B | Low Reference | 4.4 |

The present invention gave deposits equivalent to the low reference.

It has also been found that certain specific reaction products of the instant invention, when added to a motor fuel composition, have utility as carburetor detergents, i.e., for reducing and preventing the accumulation of carbon deposits in and around the throttle valve in a carburetor. For example, the reaction products set forth by Examples I, II, III, and IV of the instant invention were tested for their carburetor detergency properties as compared with a commercial motor fuel carburetor detergent additive. The tests were run, as described below, on a Chevrolet V-8 engine mounted on a test stand using a modified four barrel carburetor. The primary carburetor barrels were modified in that they had removable aluminum sleeves in the throttle plate area so that carbonaceous deposits formed on the sleeves in this area could be conveniently weighed.

CHEVROLET CARBURETOR DETERGENCY TEST

The test procedure was designed to determine the effectiveness of a given motor fuel additive in preventing or minimizing carbonaceous deposits in the area of the carburetor. After the engine was run continuously for 72 hours, the sleeves were removed from the carburetor and weighed to determine the extent of carbonaceous deposit formation. As shown below in Table VII, unleaded base fuels containing 20 PTB of the reaction products set forth by Examples I, II, III, and IV respectively were tested. In addition, the unleaded base fuel containing the commercial carburetor detergent were tested to provide a standard. As illustrated by the data in Table II, the reaction products set forth by Examples I, II, III, and IV of the instant invention gave test results comparable to those obtained with the commercial carburetor detergent. Table VII, thus, illustrates that Example I, II, III, and IV of the instant invention are approximately as effective as carburetor detergent additives in motor fuels as the commercial carburetor detergent.

TABLE VII

CHEVY CARBURETOR DETERGENCY TEST RESULTS

| Fuel Mixture | Deposits on Carburetor Sleeve in 72 Hrs. (mg) |
|---|---|
| Base Fuel + 20 PTB reaction product (Example I) | 0.6 |
| Base Fuel + commercial detergent | 0.7 |
| Base Fuel + 20 PTB reaction product (Example II) | 21.8 |
| Base Fuel + commercial detergent | 1.3 |
| Base Fuel + 20 PTB reaction product (Example III) | 1.4 |
| Base Fuel + commercial detergent | 0.7 |

Preferred motor fuel compositions for use with the reaction product additive set forth by the instant invention are those intended for use in spark ignition internal combustion engines. Such motor fuel compositions, generally referred to as gasoline base stocks, preferably comprise a mixture of hydrocarbons boiling in the gasoline boiling range, preferably from about 90° F. to about 450° F. This base fuel may consist of straight chains or branched chains or paraffins, cycloparaffins, olefins, aromatic hydrocarbons, or mixtures thereof. The base fuel can be derived from, among others, straight run naphtha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention.

In addition, the motor fuel composition may contain any of the additives generally employed in gasoline. Thus, the fuel composition can contain anti-knock compounds such as tetraethyl lead compounds, anti-icing additives, upper cylinder lubricating oils, and the like.

It is unexpected and surprising that the reaction product set forth by the instant invention is an effective ORI controlling agent and exhibits carburetor detergency properties when employed in minor amounts as an additive in motor fuels.

It will be evident that the terms and expressions employed herein are used as terms of description and not of limitation. There is no invention, in the use of these descriptive terms and expressions, of excluding equivalents of the features described and it is recognized that various modifications are possible within the scope of the invention claimed.

We claim:

1. A fuel composition for an internal combustion engine comprising:

(a) a major portion of normally liquid hydrocarbon fuel and (b) a minor amount, as a deposit inhibitor additive, of a reaction product of the process comprising:

(i) reacting a disbasic acid anhydride with a polyoxyisopropylenediamine

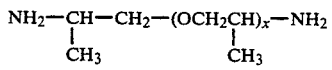

where x is a numeral of about 2 to about 68, thereby forming a maleamic acid;

(ii) reacting said maleamic acid with a N-alkyl-alkylene diamine, thereby forming a reaction product and;

(iii) recovering said reaction product.

2. The fuel composition of claim 1, wherein said polyoxyisopropylenediamine has a molecular weight $\overline{M}_n$ ranging from about 230 to about 4000.

3. The fuel composition of claim 1, wherein said polyoxyisopropylenediamine, x is a numeral of about 2 to about 33.

4. The fuel composition of claim 1, wherein said dibasic acid anhydride has the formula

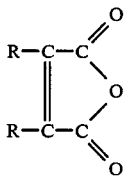

where R is H, $CH_3$— or $C_2H_5$—.

5. The fuel composition of claim 1, wherein said N-alkyl-alkylene diamine has the formula $$R'—NH—R''—NH_2$$

wherein R′ is a ($C_{8-C18}$) alkyl, alkaryl, aralkyl, aryl or cycloalkyl hydrocarbon group and R″ is a ($C_{1-C8}$) alkylene, aralkylene, alkarylene, arylene or cycloalkylene hydrocarbon group.

6. The fuel composition of claim 1, wherein the minor deposit inhibiting amount ranges from about 0.001 to about 0.1 weight percent of the said reaction product.

7. The fuel composition of claim 6, wherein the minor deposit-inhibiting amount is about 0.01 to about 0.1 weight percent of said reaction product.

8. A fuel composition for an internal combustion engine comprising:

(a) a major portion of a liquid hydrocarbon having a boiling point of 75° to 450° F. and (b) a minor amount, as a deposit-inhibiting additive of a reaction product of the process comprising:

(i) reacting a polyoxyisopropylenediamine

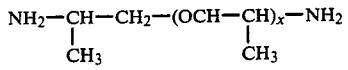

where x is a numeral of about 2 to about 68, with a dibasic acid anhydride

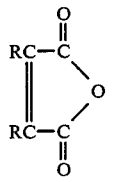

thereby forming a maleamic acid;

(ii) reacting said maleamic acid with an N-alkyl-alkylene diamine

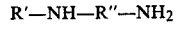

where R′ is a ($C_8$–$C_{18}$) alkyl, alkaryl, aralkyl, aryl or cycloalkyl hydrocarbon group and R″ is a ($C_1$–$C_8$) alkylene, aralkylene, alkarylene, arylene or cycloalkylene hydrocarbon group, thereby forming a reaction product

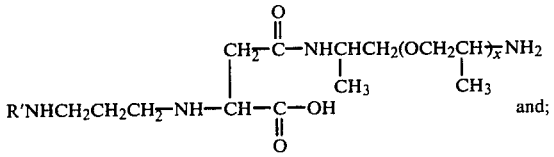

and;

(iii) recovering said reaction product.

9. A fuel composition for an internal combustion engine comprising:

(a) a major portion of a fuel having a boiling point of 75° to 450° F. and (b) about 0.01 (w)% of a deposit-inhibiting reaction product of the process comprising:

(i) reacting a polyoxyisopropylenediamine

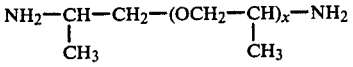

where x is a numeral of about 2 to about 68 with a maleic anhydride, thereby forming a maleamic acid

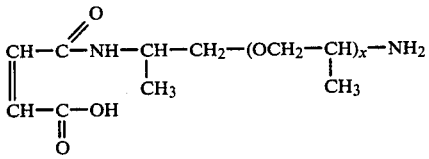

(ii) reacting said maleamic acid with N-tallow-1,3-propane diamine, thereby forming a reaction product

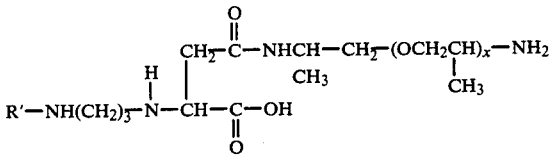

where R′ is a ($C_8$–$C_{18}$) alkyl, alkaryl, aralkyl, aryl or cycloalkyl hydrocarbon group; and (iii) recovering said reaction product.

* * * * *